United States Patent [19]

Isozumi et al.

[11] Patent Number: 4,800,766

[45] Date of Patent: Jan. 31, 1989

[54] COAXIAL TYPE STARTER

[75] Inventors: Shuzoo Isozumi; Kazuhiro Odawara, both of Hyogo, Japan

[73] Assignee: Mitsubishi Denki Kabushiki Kaisha, Tokyo, Japan

[21] Appl. No.: 159,201

[22] Filed: Feb. 23, 1988

[30] Foreign Application Priority Data

Feb. 25, 1987 [JP] Japan ..... 62-26983

[51] Int. Cl.[4] ..... F02N 15/06

[52] U.S. Cl. ..... 74/7 E; 74/7 A; 74/801; 310/83

[58] Field of Search ..... 74/7 E, 7 A, 7 R, 785, 74/788, 801; 310/83, 99; 192/3.52

[56] References Cited

U.S. PATENT DOCUMENTS 4,587,861 5/1986 Morishita ..... 74/7 E
4,760,274 7/1988 Isozumi ..... 290/48

FOREIGN PATENT DOCUMENTS 1311876 11/1962 France .

*Primary Examiner*—Leslie A. Braun
*Assistant Examiner*—Janice Chartoff
*Attorney, Agent, or Firm*—Wolf, Greenfield & Sacks

[57] ABSTRACT

A coaxial type starter used to start an engine of a vehicle is disclosed. The starter comprises first and second bearings which are respectively disposed between the outer circumferential portion of a carrier of an epicyclic reduction gear which is formed integral with a clutch outer member of an overrunning clutch and a fixed portion of the starter and between the inner circumferential portion of the carrier and the outer circumferential portion of an armature rotary shaft of a d.c. motor. Accordingly, the carrier of the epicyclic reduction gear is prevented from becoming eccentric by the first bearing, and the armature rotary shaft of the d.c. motor which is supported by the carrier through the second bearing is also prevented from becoming eccentric. Thus, it is possible to eliminate any risk of the planet gears of the epicyclic reduction gear being damaged or generating noise.

5 Claims, 3 Drawing Sheets

COAXIAL TYPE STARTER

BACKGROUND OF THE INVENTION

1. Field of the Invention

The present invention relates to a coaxial type starter and, more particularly, to a coaxial type starter used to start an engine of a vehicle.

2. Description of the Prior Art

A conventional starter used for starting the engine of a vehicle has heretofore been arranged in the manner shown in FIG. 3.

The conventional starter 1 shown in FIG. 3 comprises a d.c. motor 2, an overrunning clutch 4 slidably fitted on an output rotary shaft 3, an epicyclic reduction gear 5 which transmits the rotational force from an armature rotary shaft 2*a* of the d.c. motor 2 to the output rotary shaft 3 after the speed thereof has been reduced, and a shift lever 8 having one end thereof engaged with the plunger rod of an electromagnetic switch 6 disposed at one side of the d.c. motor 2 and the other end thereof engaged with an annular member 7 secured to the overrunning clutch 4. The shift lever 8 causes the overrunning clutch 4 to slide relative to the output rotary shaft 3 in order for the overrunning clutch 4 to engage with the output rotary shaft 3 for rotation therewith.

However, the conventional starter 1 needs the shift lever 8 in order to cause the overrunning clutch 4 to engage with the output rotary shaft 3, and the electromagnetic switch 6 which actuates the shift lever 8 and also turns on the power supply for the d.c. motor 2 is disposed at the side of the d.c. motor 2, that is to say, the starter 1 has the so-called biaxial arrangement. Therefore, the type of engine layout that can adopted in designing vehicles has heretofore been restricted to a substantial extent.

In order to avoid the above-described problem, it has been proposed that the electromagnetic switch be disposed at one axial end of the d.c. motor, allowing the starter to assume a simple configuration such as a relatively long and narrow tubular shape. According to this proposition, the starter is basically arranged such that the plunger rod of the electromagnetic switch which has heretofore been used to actuate the shift lever extends into the passage extending as far as the output rotary shaft inside the armature rotary shaft. Since the armature rotary shaft of the d.c. motor and the rod of the electromagnetic switch are disposed on the same axis this starter is known as a coaxial type starter.

The above-described conventional coaxial type starter suffers, however, from the following problems. Namely, it sometimes might happen that the central axis of the epicyclic reduction gear is eccentric with respect to the axes of the output rotary shaft and the armature rotary shaft. Since this results in placing the epicyclic reduction gear in a considerably unstable condition, there is a fear that the planet gears of the epicyclic reduction gear will be damaged or that noise will be generated at the time of high speed rotation or when a heavy impact is applied thereto. Especially in the case of the coaxial type starter, since the pins which support the planet gears are rigidly secured to a carrier which is formed integral with the clutch outer member of the overrunning clutch. It might happen that the clutch outer member is also eccentric with respect to the output rotary shaft. As a result, there is a risk that the cam surface could be dented.

SUMMARY OF THE INVENTION

In view of the above-described problems, it is a primary object of the present invention to provide a coaxial type starter which is so designed that the position of the central axis of the epicyclic reduction gear is fixed to eliminate the fear that the planet gears of the reduction gear will be damaged or that noise will be generated.

To this end, the present invention provides a coaxial type starter comprising first and second bearings which are respectively disposed between the outer circumferential portion of a carrier of an epicyclic reduction gear which is formed integral with a clutch outer member of an overrunning clutch and a fixed portion of the coaxial type starter, and between the inner circumferential portion of the carrier and the outer circumferential portion of an armature rotary shaft of a d.c. motor.

The first bearing limits eccentric rotation of the carrier of the epicyclic reduction gear which is formed integral with the clutch outer member of the overrunning clutch, and such concentric rotation of the carrier limits eccentric rotation of the armature rotary shaft of the d.c. motor which is supported by the carrier through the second bearing. Thus, the planet gears revolve about the same axis as the axis of the armature rotary shaft of the d.c. motor and the overrunning clutch also rotates about said axis.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and in which.

DESCRIPTION OF THE PREFERRED EMBODIMENTS

The coaxial type starter according to the present invention will be described hereinunder in detail by way of preferred embodiments and with reference to the accompanying drawings.

Figure 1:
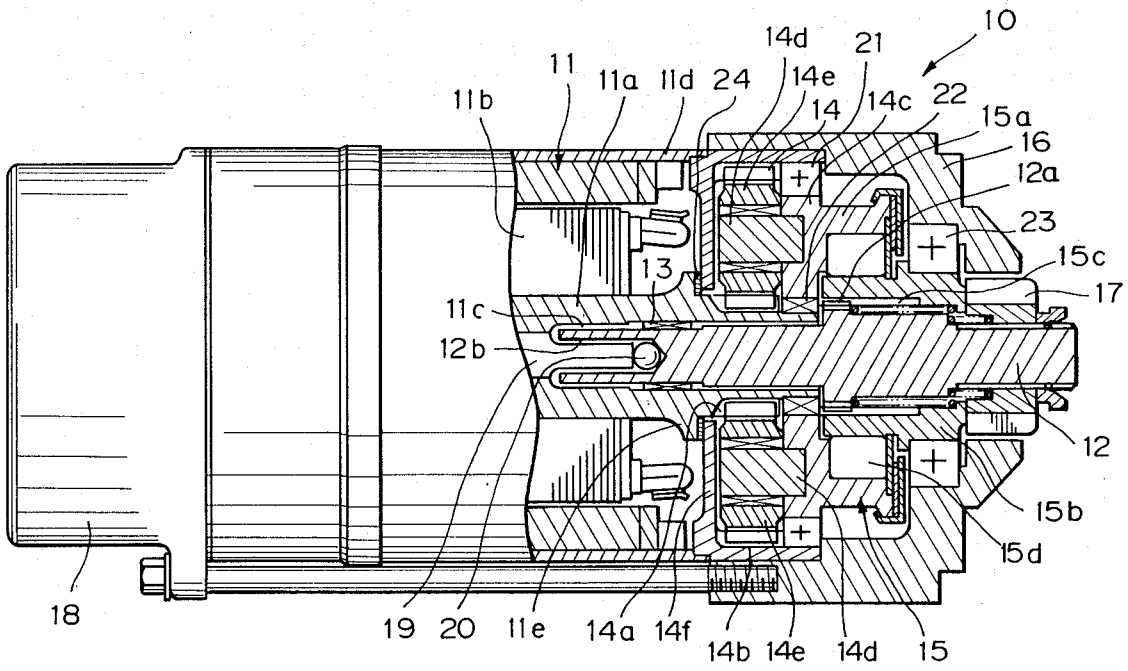
FIG. 1 a partially sectioned front view of one embodiment of the coaxial type starter according to the present invention.

Referring first to FIG. 1, which shows a first embodiment of the present invention a coaxial type starter 10 according to this embodiment includes a d.c. motor 11 having a yoke 11*d* which also serves as a machine frame of the starter 10 and a tubular armature rotary shaft 11*a* which is concentric with the yoke 11*d*. An armature core 11*b* is rigidly press-fitted on the periphery of the armature rotary shaft 11*a*. An output rotary shaft 12 is disposed concentrically with the armature rotary shaft 11*a* at one axial end (the right-hand end as viewed in FIG. 1) of the d.c. motor 11. One end portion of the output rotary shaft 12 is received in a passage 11*c* formed inside the armature rotary shaft 11*a* and is axially slidably supported through a sleeve bearing 13 which is interposed between the periphery of the output rotary shaft 12 and the inner wall of the passage 11c.

The rotational force from the armature rotary shaft 11a is transmitted to the output rotary shaft 12 through an epicyclic reduction gear 14 and an overrunning clutch 15. More specifically, the epicyclic reduction gear 14 comprises a sun gear 14a which is formed integral with the periphery of one end portion of the armature rotary shaft 11a, an internal gear 14b which is clamped between the yoke 11d of the d.c. motor 11 and a front bracket 16 of the starter, and a plurality of planet gears 14e which are meshed with the sun and internal gears 14a, 14b and rotatably carried by respective pins 14d which are rigidly secured to a carrier 14c which is formed integral with a clutch outer member 15a of the overrunning clutch 15. A helical spline 15c which is formed on the inner wall of a clutch inner member 15b of the overrunning clutch 15 is meshed with a helical spline 12a formed on the periphery of the output rotary shaft 12. Thus, the output rotary shaft 12 is able to slide axially while receiving the rotational force from the clutch inner member 15b. A pinion 17 which is engageable with a ring gear of the engine is secured to that end portion of the output rotary shaft 12 which projects from the front bracket 16.

At the other end (the left-hand end as viewed in FIG. 1) of the d.c. motor 11 is provided an electromagnetic switch 18. The function of this electromagnetic switch 18 is the same as that of the switch in the conventional starter. More specifically, the electromagnetic switch 18 is activated when the starter switch of the vehicle is closed. This causes a plunger to move by electromagnetic force generated therefrom and then the movement of the plunger causes a rod 19 to move. By the movement of the rod 19, the pinion 17 is meshed with the ring gear of the engine and the power supply for the d.c. motor 11 is also turned on.

The following is a detailed description of the arrangement of the coaxial type starter which allows the pinion 17 to mesh with the ring gear of the engine by virtue of the movement of the rod 19 of the electromagnetic switch 18.

The rod 19 is operatively connected to the plunger (not shown) of the electromagnetic switch 18 which is disposed concentrically with the armature rotary shaft 11a of the d.c. motor 11. The rod 19 extends into the passage 11c formed inside the armature rotary shaft 11 to a steel ball which is in the innermost portion of a hole 12b formed in the end portion of the output rotary shaft 12.

Disposed on the socket surface of internal gear 14b is a first bearing 21 which pivotably supports the carrier 14c of the epicyclic reduction gear 14 from the outside thereof. The inside of the carrier 14c is pivotably supported by a second bearing 22 which is disposed on the armature rotary shaft 11a. Thus, the radial movement of the carrier 14c is completely prevented by the first bearing 21 and therefore there is no room for the carrier 14c to become eccentric. Since the armature rotary shaft 11a of the d.c. motor 11 is supported by the carrier 14c through the second bearing 22, the armature rotary shaft 11a is also prevented from becoming eccentric. Further, the output rotary shaft 12 which is supported by the armature rotary shaft 11a through the bearing 13 is also prevented from becoming eccentric. Thus, all the axis of rotation of the three members, that is, the armature rotary shaft 11a, the carrier 4c of the epicyclic reduction gear 14 and the output rotary shaft 12, are coincident with each other on one mutual axis and this axis is constantly held at a fixed position. Further, one end of the clutch inner member 15b of the overrunning clutch 15 projects toward the pinion 17, and a bearing 23 is fitted on the outer periphery of the projecting end portion, the bearing 23 being retained by the front bracket 16. As a result, the axis of revolution of the planet gears 14e and the axis of rotation of the overrunning clutch 15 are also coincident with the above-described mutual axis, and there is no room for these members to become eccentric.

The internal gear 14b of the epicyclic reduction gear 14 has a flange portion 14f which extends radially inward at the end of the gear 14b which is closer to the d.c. motor 11, and a thrust washer 24 is disposed between a projection 11e formed on the periphery of the armature rotary shaft 11a and the side surface of the flange portion 14f.

The operation of the starter in accordance with this embodiment will next be described.

When the starter switch of the vehicle is closed, the coil of the electromagnetic switch 18 is energized, and the rod 19 is moved axially rightward (as viewed in FIG. 1) by virtue of the electromagnetic force generated by the excitation of the coil. In consequence, the output rotary shaft 12 is pushed out, thus causing the pinion 17 provided on the end portion of the shaft 12 to mesh with the ring gear of the engine. At the same time, movable and fixed contacts (not shown) are brought into contact with each other by the movement of the plunger and the power supply for the d.c. motor 11 is thereby turned on to activate the d.c. motor. As a result, the rotational force from the armature rotary shaft 11 is transmitted to the clutch outer member 15a of the overrunning clutch 15 after the speed thereof has been reduced by the epicyclic reduction gear 14, and the rotation of the clutch outer member 15a is then transmitted to the clutch inner member 15b through a columnar roller 15d. The rotation of the clutch inner member 15b is transmitted to the output rotary shaft 12 through the helical splines 15c and 12a, thereby rotating the pinion 17 and thus starting the engine.

After the engine has been started, reverse drive is prevented by the overrunning clutch 15, and the output rotary shaft 12 as well as the plunger and rod 19 of the electromagnetic switch 18 are returned to their previous positions by a return spring disposed at an appropriate position.

Thus, in the coaxial type starter 10 which has the planet gears 14 supported by the carrier 14c formed integral with the clutch outer member 15a of the overrunning clutch 15, the carrier 14c is supported by the bearing 21 disposed between the outer circumferential portion of the carrier 14c and the fixed portion of the starter and the end portion of the armature rotary shaft 11a is supported by the carrier 14c through the bearing 22, whereby various portions, particularly the epicyclic reduction gear 14 and the overrunning clutch 15 are prevented from becoming eccentric.

Figure 2:
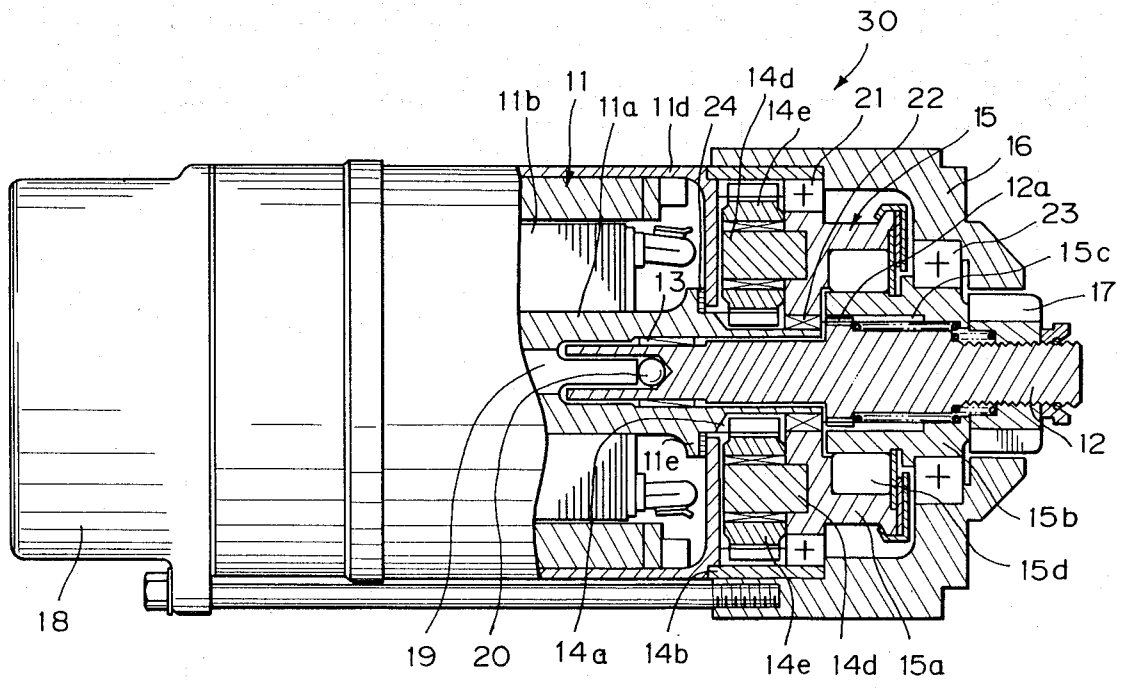
FIG. 2 is a partially sectioned front view of a second embodiment of the coaxial type starter according to the present invention.
Figure 3:
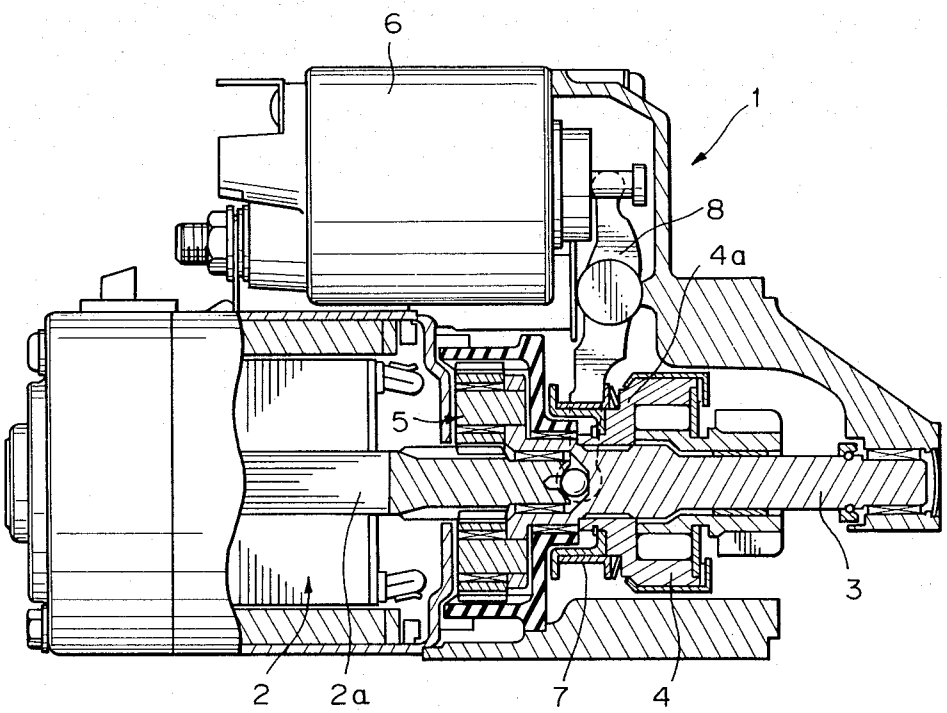
Fig. 3 PRIOR ART
FIG. 3 is a partially sectioned front view of a conventional biaxial type starter.

Referring next to FIG. 2, which shows a second embodiment of the present invention, a coaxial type starter 30 according to this embodiment has the same arrangement as that of the embodiment shown in FIG. 1 except that the flange portion which is formed integral with the internal gear in the starter shown in FIG. 1 is formed integral with the yoke 11d of the d.c. motor 11. Accordingly, members or portions of this embodiment which correspond to those of the first embodiment are denoted by the same reference numerals and description thereof is omitted As has been described above, it is possible according to the present invention to prevent the overrunning clutch and the epicyclic reduction gear from becoming eccentric with respect to each other and consequently ensure stable operation of the coaxial type starter.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A coaxial type starter including a motor having a tubular armature rotary shaft an output rotary shaft disposed concentrically with said armature rotary shaft at one axial end of said motor and axially slidably supported by said armature rotary shaft, an overrunning clutch for transmitting the rotation of said armature rotary shaft to said output rotary shaft, an epicyclic reduction gear for reducing the speed of rotation which is transmitted from said armature rotary shaft to said output rotary shaft through said overrunning clutch, said reduction gear having a plurality of planet gears rotatably supported through respective pins on a carrier which is formed integral with a clutch outer member of said overrunning clutch, an electromagnetic switch provided at the other axial end of said motor, and an actuating member for applying force for axial movement to said output rotary shaft in response to the action of said electromagnetic switch, wherein the improvement comprises a first bearing disposed between the outer circumferential portion of said carrier of said epicyclic reduction gear which is formed integral with said clutch outer member and a fixed portion of said coaxial type starter, and a second bearing disposed between the inner circumferential portion of said carrier and the outer circumferential portion of said armature rotary shaft.

2. A coaxial type starter as claimed in claim 1, wherein said output rotary shaft is received in said armature rotary shaft and the improvement further comprises a third bearing disposed between the inner circumferential portion of said armature rotary shaft and the outer circumferential portion of said output rotary.

3. A coaxial type starter as claimed in claim 2, wherein said overrunning clutch has a clutch inner member and the improvement further comprises a fourth bearing disposed between said fixed portion of said coaxial type starter and the outer circumferential of said clutch inner member.

4. A coaxial type starter as claimed in claim 1, wherein said epicyclic reduction gear has an internal gear fixed to said fixed portion of said coaxial member and engaged with said planet gears, said internal gear having a flange portion formed integral therewith, and said armature rotary shaft has a projection formed thereon which is engaged with said flange portion through a thrust washer so as to prevent the axial movement of said armature rotary shaft.

5. A coaxial type starter as claimed in claim 1, wherein said motor has a yoke which serves as a machine frame of said starter, said yoke having a flange portion formed integral therewith, and said armature rotary shaft has a projection formed thereon which is engaged with said flange portion through a thrust washer so as to prevent the axial movement of said armature rotary shaft.

* * * * *